US010723977B2

(12) United States Patent
Klemmer et al.

(10) Patent No.: US 10,723,977 B2
(45) Date of Patent: Jul. 28, 2020

(54) LIQUID WASHING OR CLEANING AGENT CONTAINING AN N,N'-DIARYLAMIDOCYSTINE DERIVATIVE

(71) Applicant: Henkel AG & Co. KGaA, Duesseldorf (DE)

(72) Inventors: Anna Klemmer, Duesseldorf (DE); Peter Schmiedel, Duesseldorf (DE); Filiz Yapici, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/950,463

(22) Filed: Apr. 11, 2018

(65) Prior Publication Data

US 2018/0230406 A1 Aug. 16, 2018

Related U.S. Application Data

(63) Continuation of application No. PCT/EP2016/074098, filed on Oct. 7, 2016.

(30) Foreign Application Priority Data

Oct. 13, 2015 (DE) ..... 10 2015 219 846

(51) Int. Cl.

| | |
|---|---|
| ***C11D 1/22*** | (2006.01) |
| ***C11D 3/34*** | (2006.01) |
| ***C11D 17/00*** | (2006.01) |
| ***C11D 1/83*** | (2006.01) |
| *C11D 1/24* | (2006.01) |
| *C11D 1/29* | (2006.01) |
| *C11D 1/72* | (2006.01) |

(52) U.S. Cl.
CPC ..... *C11D 3/349* (2013.01); *C11D 1/83* (2013.01); *C11D 17/0008* (2013.01); *C11D 17/0026* (2013.01); *C11D 1/24* (2013.01); *C11D 1/29* (2013.01); *C11D 1/72* (2013.01)

(58) Field of Classification Search
CPC ..... C11D 3/349; C11D 17/0026; C11D 1/83; C11D 17/0008; C11D 1/24; C11D 1/29; C11D 1/72
See application file for complete search history.

(56) References Cited

U.S. PATENT DOCUMENTS

2003/0125222 A1 7/2003 Jahns et al.
2006/0099270 A1* 5/2006 Friggeri ..... A61K 9/14 424/489

FOREIGN PATENT DOCUMENTS

| | | | |
|---|---|---|---|
| DE | 102008051799 | A1 | 4/2010 |
| WO | 0149817 | A2 | 7/2001 |
| WO | 03084508 | A1 | 10/2003 |
| WO | 2013064356 | A1 | 5/2013 |

OTHER PUBLICATIONS

Wang, Hong et al., "Electrochemical Characterization of the Hydrophobic Microenvironment within Gemini Surfactant Micellar-Hybridized Supramolecular Gels", Electrochimica Acta. XP028578108. vol. 90, pp. 326-331, 2013.*
PCT International Search Report PCT/EP2016/074098 completed: Dec. 12, 2016; dated Dec. 19, 2016 3 pages.

* cited by examiner

*Primary Examiner* — Charles I Boyer
(74) *Attorney, Agent, or Firm* — Thomas G. Krivulka

(57) ABSTRACT

Surfactant compositions having a yield point, containing, based on the total weight thereof, (i) at least one surfactant, and (ii) at least one diarylamidocystine compound of the formula (I), wherein $X^+$, independently of each other, stands for a hydrogen atom or an equivalent of a cation, $R^1$, $R^2$, $R^3$, and $R^4$, independently of each other, stand for a hydrogen atom, a halogen atom, a $C_1$-$C_4$ alkyl group, a $C_1$-$C_4$-Alkoxy group, a $C_2$-$C_4$ hydroxyalkyl group, a hydroxyl group, an amino group, an N—($C_1$-$C_4$ alkyl)amino group, an N,N-Di ($C_1$-$C_4$ alkyl)amino group, an N—($C_2$-$C_4$ hydroxyalkyl) amino group, an N,N-Di($C_2$-$C_4$ hydroxyalkyl)amino group, or $R_1$ with $R_2$ or $R_3$ with $R_4$ forms a 5- or 6-segment annulated ring, which can each be substituted with at least one group from $C_1$-$C_4$ alkyl group, $C_1$-$C_4$ alkoxy group, $C_2$-$C_4$ hydroxyalkyl group, hydroxyl group, amino group, N—($C_1$-$C_4$ alkyl)amino group, N,N-Di($C_1$-$C_4$ alkyl)amino group, N—($C_2$-$C_4$ hydroxyalkyl)amino group, N,N-Di($C_2$-$C_4$ hydroxyalkyl)amino group, and (iii) water.

11 Claims, No Drawings

LIQUID WASHING OR CLEANING AGENT CONTAINING AN N,N'-DIARYLAMIDOCYSTINE DERIVATIVE

FIELD OF THE INVENTION

The present invention relates to liquid surfactant compositions, in particular washing or cleaning agents, that contain at least one N,N'-diarylamidocystine derivative and have a yield point, as well as to a method for preparing a surfactant composition of this type, to the use of the surfactant composition as a continuous phase for preparing suspensions and to the use of the surfactant composition for textile care.

BACKGROUND OF THE INVENTION

For incorporating liquid surfactant compositions, in particular washing or cleaning agents, either those ingredients that dissolve in the liquid phase of the agent or those that can be accordingly homogeneously suspended in an undissolved manner are available. For insoluble ingredients, a stable, homogeneous suspension is required for the function and aesthetics of the washing or cleaning agent. Sedimented solid particles may clump together and, when used, may lead to local excess concentrations of the ingredient and thus to uneven dosing per wash load. In addition, visible clumps, greasy deposits or residues of the solid ingredient on an, e.g., transparent wall of the storage container are not aesthetically pleasing.

Certain, optionally dyed, solid particles, which are visible to the naked human eye in suspension in a, transparent or translucent, liquid phase as individualized particles and are incorporated, are often referred to as speckles. For this purpose, corresponding particles have an appropriate particle size and are aesthetically attractive to the consumer. Microcapsules are also solid ingredients and include any type of capsule known to a person skilled in the art, but in particular core-shell capsules and matrix capsules. Matrix capsules are porous shaped bodies that have a structure similar to a sponge. Core-shell capsules are shaped bodies that have a core and a shell.

However, all of these solid particles, in particular the speckles, tend towards sedimentation in liquid surfactant compositions.

The sedimentation of particles out of the suspension is usually prevented by the use of surfactant compositions having a yield point. A yield point can be produced by selecting specific surfactant combinations, usually in the presence of an electrolyte salt, by establishing a lamellar phase. It is also conceivable to use selected polymer thickeners for producing a yield point.

In particular, it is difficult to provide surfactant compositions having a high surfactant concentration with a yield point in the range of from 0.01 to 5 Pa. By using lyotropic liquid-crystalline mesophases, an excessively high yield point is usually achieved at a high surfactant concentration. In such a case, the flow behavior is inhomogeneous (what is known as "clumpy" flow). Furthermore, an excessively high yield point results in the suspended particles adhering to the wall of the storage container for the surfactant composition. If polymer thickeners are used to form the yield point, at a high surfactant concentration this is sometimes achieved by using a very high quantity of the polymer thickener, and often is not achieved at all. Large quantities of thickener impair the cleaning performance of surfactant compositions, and in textile treatment this can in particular additionally result in graying of the textile.

BRIEF SUMMARY OF THE INVENTION

The problem addressed by the present invention is to provide liquid surfactant compositions, in particular washing or cleaning agents having excellent washing or cleaning performance, which have a yield point and in which solid particles (in particular speckles) that remain stable in suspension under storage conditions can be homogeneously suspended.

Surprisingly, it has been found that a yield point can be produced by adding N,N'-diarylamidocystine to liquid surfactant compositions almost irrespective of the quantity of surfactant. If these surfactant compositions are used as a continuous phase of a suspension, the solid phase is suspended homogeneously and stably therein. In addition, a thermodynamically multiphase formulation can prevent macroscopic separation. By adding the N,N'-diarylamidocystine, a formulation that consists of a plurality of immiscible liquid phases, similarly to an emulsion, can be converted into a storage-stable, macroscopically single-phase and homogeneous product.

A first subject of the invention is directed to liquid surfactant compositions having a yield point (in particular liquid washing or cleaning agents that each have a yield point, preferably liquid washing agents having a yield point) containing, based on the total weight thereof, (i) at least one surfactant in a total quantity of 1 to 70 wt. %, and (ii) at least one diarylamidocystine compound of the formula (I),

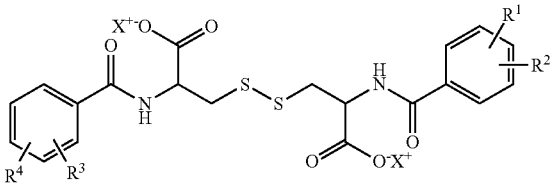

wherein $X^+$, independently of each other, stands for a hydrogen atom or an equivalent of a cation, $R^1$, $R^2$, $R^3$, and $R^4$, independently of each other, stand for a hydrogen atom, a halogen atom, a $C_1$-$C_4$ alkyl group, a $C_1$-$C_4$ alkoxy group, a $C_2$-$C_4$ hydroxyalkyl group, a hydroxyl group, an amino group, an N—($C_1$-$C_4$ alkyl) amino group, an alkyl)amino group, an N—($C_2$-$C_4$ hydroxyalkyl)amino group, an N,N-Di($C_2$-$C_4$ hydroxyalkyl)amino group, or $R^1$ with $R^2$ or $R^3$ with $R^4$ forms a 5- or 6-segment annulated ring, which in turn can each be substituted with at least one group from $C_1$-$C_4$ alkyl group, $C_1$-$C_4$ alkoxy group, $C_2$-$C_4$ hydroxyalkyl group, hydroxyl group, amino group, N—($C_1$-$C_4$ alkyl) amino group, N,N-Di($C_1$-$C_4$ alkyl)amino group, N—($C_2$-$C_4$ hydroxyalkyl)amino group, N,N-Di($C_2$-$C_4$ hydroxyalkyl)amino group, and (iii) water.

The liquid surfactant compositions may be washing agents for textiles, carpets or natural fibers. In the context of the invention, the washing agents also include auxiliary washing agents, which are added to the actual washing agent when washing textiles manually or using a machine in order to achieve an additional effect. Furthermore, in the context of the invention, washing agents also include textile pre-treatment and post-treatment agents, i.e. agents with which the piece of laundry comes into contact before it is actually washed, for example in order to loosen stubborn dirt.

The yield point refers to the lowest stress (force per surface area) above which a plastic substance behaves rheologically, like a liquid. It is given in pascals (Pa). According to the invention, it is preferable for the liquid surfactant composition to have a yield point of at least 0.01 to 5 Pa (20° C.), particularly preferably of at least 0.02 to 4 Pa (20° C.).

The yield points of the washing or cleaning agents were measured using an AR G2-type rotational rheometer from TA-Instruments. This is what is known as a controlled shear stress rheometer.

In order to measure a yield point using a controlled shear stress rheometer, various methods are described in the literature that are known to a person skilled in the art.

In order to determine the yield points within the context of the present invention, the following was carried out at 20° C.:

Shear stress δ increasing at intervals over time was applied to the samples in the rheometer in a stepped-flow procedure. For example, the shear stress can be increased from the smallest possible value (e.g. 2 mPa) to e.g. 10 Pa over the course of 10 minutes with 10 points per shear stress decade. In this process, the time interval is selected such that the measurement is carried out "quasistatically", i.e., such that the deformation of the sample for each specified shear stress value can come into equilibrium. The equilibrium deformation γ of the sample is measured as a function of this shear stress. The deformation is plotted against the shear stress in a double-logarithmic plot. Provided that the sample tested has a yield point, a distinction can clearly be made between two regions in this plot. Below a certain shear stress, purely elastic deformation occurs in accordance with Hooke's law. The gradient of the curve γ(δ) (log-log plot) in this region is one. Above this shear stress, the yield region begins and the gradient of the curve rises steeply. The shear stress at which the curve deviates sharply, i.e. the transition from elastic to plastic deformation, marks the yield point. It is possible to easily determine the deviation point by applying tangents to the two parts of the curve. Samples without a yield point do not have a characteristic deviation in the γ(δ) function.

"At least one", as used herein, refers to one or more, for example 1, 2, 3, 4, 5, 6, 7, 8, 9 or more.

"Liquid" means that the washing or cleaning agent is in liquid form and is in particular flowable at room temperature, i.e. approximately 20° C., and can thus be poured out of a container, for example.

"Solid" refers to a substance that is in the form of solid matter at 20° C. Capsules are considered to be solid within the meaning of the invention if they are macroscopically in the form of solid matter at 20° C. despite potentially containing liquid components.

DETAILED DESCRIPTION OF THE INVENTION

The surfactant composition according to the invention contains at least one surfactant in a total quantity of 1 to 70 wt. %. It is preferable according to the invention for the surfactant composition to contain at least one surfactant in a total quantity of 1.0 to 50 wt. %, particularly preferably of 1.0 to 40 wt. %, more preferably of 1.5 to 35 wt. %, more particularly preferably of 2 to 30 wt. %, more preferably of 2 to 25 wt. %, more preferably still of 2 to 20 wt. %, and most preferably of 2 to 10 wt. %.

The surfactant composition according to the invention preferably contains at least one anionic surfactant. It is preferable for the anionic surfactant to be selected from the group consisting of $C_{8-18}$ alkylbenzene sulfonates, olefin sulfonates, $C_{12-18}$ alkane sulfonates, ester sulfonates, alk(en)yl sulfates, fatty alcohol ether sulfates and mixtures thereof. Particularly preferably, the anionic surfactant is selected from at least one $C_{8-18}$ alkylbenzene sulfonate.

It has been found that these sulfonate and sulfate surfactants are particularly well suited to preparing stable liquid washing agents having a yield point.

It is preferable according to the invention for the surfactant composition to contain at least one anionic surfactant of formula (T1)

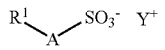

(T1)

wherein $R^1$ stands for a linear or branched, substituted or unsubstituted functional group, selected from alkyl, aryl or alkyl aryl functional groups and the group -A- stands for a chemical bond or a functional group $—(OZ)_n—O—$, wherein OZ stands for an ethylene oxide (EO) group or propylene oxide (PO) group and n stands for an integer from 1 to 50, preferably from 1 to 20 and in particular from 2 to 10, more particularly preferably 2, 3, 4, 5, 6, 7 or 8, $Y^+$ stands for a monovalent cation or the n-th part of an n-valent cation.

In this case, according to the invention it has proved suitable for said surfactant composition to contain at least one such surfactant of the above formula (I), in which A according to formula (T1) stands for the structural unit $—(OZ)_n—O—$, where OZ stands for an ethylene oxide (EO) group or propylene oxide (PO) group and n stands for an integer from 1 to 50, preferably from 1 to 20 and in particular from 2 to 10, more particularly preferably 2, 3, 4, 5, 6, 7 or 8, and $R^1$ according to formula (T1) stands for a linear or branched, substituted or unsubstituted alkyl functional group. Alkyl ether sulfates of formula (T1-1) result therefrom

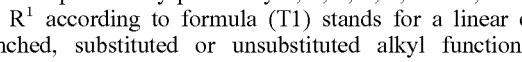

$R^1—(OZ)_n—O—SO_3^-Y^+$ (T1-1).

In this formula (T1-1), $R^1$ stands for a linear or branched, substituted or unsubstituted alkyl functional group, preferably for a linear, unsubstituted alkyl functional group, particularly preferably for a fatty alcohol functional group. Preferred functional groups $R^1$ are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^1$ are derived from C12-C18 fatty alcohols, for example from coconut fatty alcohol, tallow fatty alcohol, lauryl, myristyl, cetyl or stearyl alcohol or from $C_{10}$-$C_{18}$ oxo alcohols. $Y^+$ is as previously specified in formula (T1).

According to formula (T1-1), OZ stands for an ethylene oxide (EO) group or propylene oxide (PO) group, preferably for an ethylene oxide group. According to formula (I-1), the index n stands for an integer from 1 to 50, preferably from 1 to 20, and in particular from 2 to 10. More particularly preferably, n stands for the numbers 2, 3, 4, 5, 6, 7 or 8. According to formula (T1-1), $Y^+$ stands for a monovalent cation or the n-th part of an n-valent cation, in this case, the alkali metal ions including $Na^+$ or $K^+$ being preferred, with $Na^+$ being particularly preferred. Additional cations can be selected from $NH_4^+$, $\frac{1}{2}Zn^{2+}$, $\frac{1}{2}Mg^{2+}$, $\frac{1}{2}Ca^{2+}$, $\frac{1}{2}Mn^{2+}$, and mixtures thereof.

Washing or cleaning agents may contain at least one alkyl ether sulfate selected from fatty alcohol ether sulfates of formula (T1-2) as a compound of formula (I), (T1-2)

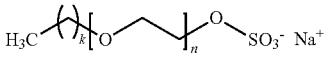

where k=11 to 19, n=2, 3, 4, 5, 6, 7 or 8. More particularly preferred representatives are Na-C12-14 fatty alcohol ether sulfates with 2 EO (k=11-13, n=2 in formula A-1). The degree of ethoxylation indicated represent a statistical average that can correspond to an integer or a fractional number for a specific product. The degrees of alkoxylation indicated represent statistical averages that can correspond to an integer or a fractional number for a specific product. Preferred alkoxylates/ethoxylates have a narrowed homolog distribution (narrow range ethoxylates, NRE).

It is preferable according to the invention for the surfactant compositions according to the invention to contain at least one compound of formula (T1-3) as the anionic surfactant of formula (T1)

(T1-3)

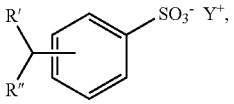

in which

R' and R", independently of each other, are H or alkyl, and together contain 9 to 19, preferably 9 to 15 and in particular 9 to 13 C atoms, and $Y^+$ indicates a monovalent cation or the n-th part of an n-valent cation (in particular $Na^+$) (proceeding from formula (T1): -A-=chemical bond, $R^1$=linear or branched alkyl aryl, $Y^+=Na^+$). A more particularly preferred representative can be described by the formula (T1-3a):

(T1-3a)

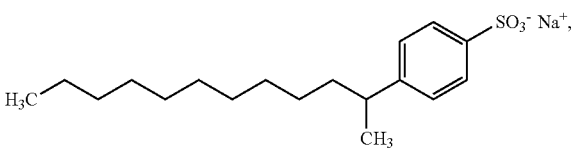

The thickening of surfactant compositions containing

The washing or cleaning agents according to the invention may contain, as a surfactant of formula (T1), a combination of at least one fatty alcohol ether sulfate of formula (T1-2)

(T1-2)

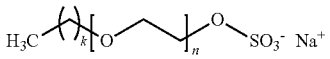

where k=11 to 19, n=2, 3, 4, 5, 6, 7 or 8 (particularly preferred representatives are Na—$C_{12-14}$ fatty alcohol ether sulfates with 2 EO k=11-13, n=2 in formula A-1), and at least one linear or branched alkylbenzene sulfonate of formula A-4

(T1-3)

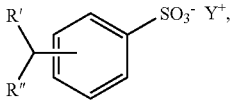

in which R' and R" together contain 9 to 19, preferably 11 to 15 and in particular 11 to 13 C atoms, and $Y^+$ stands for $Na^+$ (in particular of the above formula (T1-3a)).

In addition to the anionic surfactant, the liquid washing or cleaning agents may also contain soaps. Saturated and unsaturated fatty acid soaps are suitable, such as the salts of lauric acid, myristic acid, palmitic acid, stearic acid, (hydrogenated) erucic acid and behenic acid, and in particular soap mixtures derived from natural fatty acids, such as coconut, palm kernel, olive oil or tallow fatty acids.

The surfactant composition according to the invention may contain at least one non-ionic surfactant as the surfactant. In a particularly preferably embodiment, the surfactant composition according to the invention additionally contains at least one non-ionic surfactant in addition to an anionic surfactant. Suitable additional non-ionic surfactants include alkoxylated fatty acid alkyl esters, alkoxylated fatty acid amides, hydroxylated alkyl glycol ethers, polyhydroxy fatty acid amides, alkylphenol polyglycol ethers, amine oxides, alkyl(poly)glucosides and mixtures thereof.

Particularly preferably, the agent according to the invention contains at least one compound of formula (T2) as a non-ionic surfactant, $$R^2—O—(XO)_m—H, \quad (T2)$$

in which $R^2$ stands for a linear or branched $C_8$-$C_{18}$ alkyl functional group, an aryl functional group or an alkyl aryl functional group, XO independently of each other stands for an ethylene oxide (EO) group or a propylene oxide (PO) group, m stands for integers from 1 to 50.

Particularly preferred functional groups $R^2$ of formula (T2) are derived from $C_{12}$-$C_{18}$ fatty alcohols, for example from coconut fatty alcohol, tallow fatty alcohol, lauryl, myristyl, cetyl or stearyl alcohol or from $C_8$-$C_{18}$ oxo alcohols.

According to formula (T2), XO preferably stands for an ethylene oxide group.

According to formula (T2), the index m preferably stands for a number from 1 to 20, and in particular from 2 to 10. More particularly preferably, m stands for the numbers 2, 3, 4, 5, 6, 7 or 8.

Non-ionic surfactants that are preferably used are alkoxylated, advantageously ethoxylated, in particular primary alcohols with preferably 8 to 18 C atoms and, on average, 4 to 12 mols of ethylene oxide (EO) per mol of alcohol, in which the alcohol functional group can be linear or preferably methyl-branched in the 2 position, or it can contain linear and methyl-branched functional groups in admixture, as are usually present in oxo alcohol functional groups. However, alcohol ethoxylates having linear functional groups of alcohols of native origin having 12 to 18 C atoms, for example of coconut, palm, tallow fatty or oleyl alcohol, and an average of 4 to 8 EO per mole of alcohol are particularly preferred. Examples of preferred ethoxylated alcohols are $C_{12-14}$ alcohols with 4 EO or 7 EO, $C_{9-11}$ alcohols with 7 EO, $C_{13-15}$ alcohols with 5 EO, 7 EO or 8 EO, $C_{12-18}$ alcohols with 5 EO or 7 EO, and mixtures thereof. Preferred alcohol ethoxylates have a narrowed homolog distribution (narrow range ethoxylates, NRE). In addition to or instead of these preferred non-ionic surfactants, fatty alcohols with more than 12 EO can also be used. Examples of these are tallow fatty alcohols with 14 EO, 25 EO, 30 EO, or 40 EO. Non-ionic surfactants that contain EO and PO groups together in the molecule can also be used according to the invention. Furthermore, a mixture of a (more highly) branched ethoxylated fatty alcohol and an unbranched ethoxylated fatty alcohol, such as a mixture of a $C_{16-18}$ fatty alcohol with 7 EO and 2-propylheptanol with 7 EO. In particular, the surfactant composition according to the invention preferably contains a $C_{12-18}$ fatty alcohol with 7 EO or a $C_{13-15}$ oxo alcohol with 7 EO as the non-ionic surfactant.

In principle, all the amine oxides found in the prior art for this purpose, i.e. compounds that have the formula $R^1R^2R^3NO$, wherein each of $R^1$, $R^2$ and $R^3$, independently of one another, are an optionally substituted $C_1$-$C_{30}$ hydrocarbon chain, can be used as the amine oxide. Amine oxides that are particularly preferably used are those in which $R^1$ is $C_{12}$-$C_{18}$ alkyl and $R^2$ and $R^3$ are, independently of one another, each $C_1$-$C_4$ alkyl, in particular $C_{12}$-$C_{18}$ alkyl dimethyl amine oxides. Examples of representatives of suitable amine oxides are N-coconut alkyl-N,N-dimethyl amine oxide, N-tallow alkyl-N,N-dihydroxyethyl amine oxide, myristyl-/cetyl dimethyl amine oxide or lauryl dimethyl amine oxide.

The surfactant composition according to the invention necessarily contains at least one diarylamidocystine compound of the formula (I) (vide supra).

Said cystine compound of formula (I) contains at least two stereocenters (configuration isomers) on the alpha carbon atom of the structural fragment of the compound of formula (I) that is derived from the amino acid cysteine (see symbols α and α')

(I)

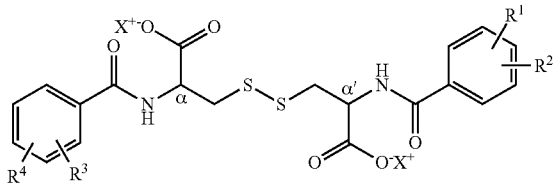

Each of these stereocenters can, independently of each other, stand for the L or D stereoisomer. It is preferable according to the invention for said cystine compound of formula (I) to be derived from the L stereoisomer of the cysteine.

Preferred surfactant compositions contain at least one compound of formula (I), in which $R^1$, $R^2$, $R^3$, and $R^4$, independently of each other, stand for a hydrogen atom, a halogen atom, a $C_1$-$C_4$ alkyl group, a $C_1$-$C_4$ alkoxy group, a $C_2$-$C_4$ hydroxyalkyl group, a hydroxyl group, or $R^1$ with $R^2$ or $R^3$ with $R^4$ forms a 5- or 6-segment annulated ring, which in turn can each be substituted with at least one group from $C_1$-$C_4$ alkyl group, $C_1$-$C_4$ alkoxy group, $C_2$-$C_4$ hydroxyalkyl group, or hydroxyl group. In particular, those compositions which contain N,N'-dibenzoylcystine ($R^1$=$R^2$=$R^3$=$R^4$=hydrogen atom; $X^+$=independently of each other, for a hydrogen atom or an equivalent of a cation), preferably N,N'-dibenzoyl-L-cystine, as a diarylamidocystine compound of formula (I) are particularly preferred.

It is preferable according to the invention for the surfactant compositions to contain the diarylamidocystine compound of formula (I), in particular selected from the preferred representatives thereof, in a total quantity of 0.1 to 5.0 wt. %, in particular 0.2 to 2.0 wt. %.

The surfactant compositions according to the invention are liquid and contain water. In this case, it is preferable for the surfactant composition to contain greater than 5 wt. %, preferably greater than 15 wt. % and particularly preferably greater than 25 wt. % water, in each case based on the total quantity of surfactant composition. Particularly preferred liquid washing agents contain, based on the weight thereof, 5 to 90 wt. %, preferably 10 to 85 wt. %, particularly preferably 25 to 75 wt. %, and in particular 35 to 65 wt. % water. Alternatively, the washing agents may be low-water to water-free washing agents, the water content in a preferred embodiment being less than 10 wt. % and more preferably less than 8 wt. %, in each case based on the total liquid washing agent.

In addition, non-aqueous solvents may be added to the surfactant composition. Suitable non-aqueous solvents include monovalent or polyvalent alcohols, alkanol amines or glycol ethers, if they can be mixed with water in the stated concentration range. Preferably, the solvents are selected from ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures of these solvents. It is however preferable for the washing agent to contain an alcohol, in particular ethanol and/or glycerol, in quantities of between 0.5 and 5 wt. %, based on the total composition.

In the context of a preferred embodiment according to the invention, the surfactant composition according to the invention contains suspended solid particles (also referred to as particles in the following). Suspended solid particles of this type are understood to be solid substances that do not dissolve in the liquid phase of the surfactant composition according to the invention at 20° C. and are present as a separate phase.

The particles are preferably selected from polymers, pearlescing pigments, microcapsules, speckles or mixtures thereof.

Within the meaning of the present invention, microcapsules include any type of capsule known to a person skilled in the art, but in particular core-shell capsules and matrix capsules. Matrix capsules are porous shaped bodies that have a structure similar to a sponge. Core-shell capsules are shaped bodies that have a core and a shell. Those capsules that have an average diameter $X_{50.3}$ (volume average) of 0.1 to 200 μm, preferably of 1 to 100 μm, more preferably of 5 to 80 particularly preferably of 10 to 50 μm and in particular of 15 to 40 μm are suitable as microcapsules. The average particle size diameter $X_{50.3}$ is determined by sieving or by means of a Camsizer particle size analyzer from Retsch.

The microcapsules of the invention preferably contain at least one active ingredient, preferably at least one odorant. These preferred microcapsules are perfume microcapsules.

In a preferred embodiment of the invention, the microcapsules have a semi-permeable capsule wall (shell).

A semi-permeable capsule wall within the meaning of the present invention is a capsule wall that is semipermeable, i.e., continuously releases small quantities of the capsule core over time, without the capsules, e.g., being destroyed or opened, e.g., by tearing. These capsules continuously release small quantities of the active ingredient contained in the capsule, e.g., perfume.

In another preferred embodiment of the invention, the microcapsules have an impermeable shell. An impermeable shell within the meaning of the present invention is a capsule wall that is substantially not permeable, i.e., only releases the capsule core by the capsule being damaged or opened. These capsules contain significant quantities of the at least one odorant in the capsule core, and therefore when the capsule is damaged or opened, a very intense fragrance is provided. The fragrance intensities thus achieved are generally so high that lower quantities of the microcapsules can be used in order to achieve the same fragrance intensity as for conventional microcapsules.

In a preferred embodiment of the invention, the surfactant composition according to the invention contains both microcapsules having a semipermeable shell and also microcapsules having an impermeable shell. By using both types of capsule, a significantly improved fragrance intensity can be provided over the entire laundry cycle.

In another preferred embodiment of the invention, the surfactant composition according to the invention may also contain two or more different microcapsule types having semipermeable or impermeable shells.

High-molecular compounds are usually considered as materials for the shell of the microcapsules, such as protein compounds, for example gelatin, albumin, casein and others, cellulose derivatives, for example methylcellulose, ethylcellulose, cellulose acetate, cellulose nitrate, carboxymethylcellulose and others, and especially also synthetic polymers such as polyamides, polyethylene glycols, polyurethanes, epoxy resins and others. Preferably, melamine formaldehyde polymers, melamine urea polymers, melamine urea formaldehyde polymers, polyacrylate polymers or polyacrylate copolymers are used as the wall material, i.e., as the shell. Capsules according to the invention are for example, but not exclusively, described in US 2003/0125222 A1, DE 10 2008 051 799 A1 or WO 01/49817.

Preferred melamine formaldehyde microcapsules are prepared by melamine formaldehyde precondensates and/or the $C_1$-$C_4$ alkyl ether thereof in water, by the at least one odor modulator compound and optionally other ingredients, such as at least one odorant, condensing in the presence of a protective colloid. Suitable protective colloids are e.g. cellulose derivatives, such as hydroxyethyl cellulose, carboxymethyl cellulose and methylcellulose, polyvinylpyrrolidone, copolymers of N-vinylpyrrolidone, polyvinyl alcohols, partially hydrolyzed polyvinyl acetates, gelatin, arabic gum, xanthan gum, alginates, pectins, degraded starches, casein, polyacrylic acid, polymethacrylic acid, copolymerisates of acrylic acid and methacrylic acid, sulfonic-acid-group-containing water-soluble polymers having a content of sulfoethyl acrylate, sulfoethyl methacrylate or sulfopropyl methacrylate, and polymerisates of N-(sulfoethyl)-maleinimide, 2-acrylamido-2-alkyl sulfonic acids, styrene sulfonic acids and formaldehyde and condensates of phenol sulfonic acids and formaldehyde.

It is preferable for the surface of the microcapsules according to the invention to be coated entirely or in part with at least one cationic polymer. Accordingly, at least one cationic polymer from the group comprising polyquaternium-1, polyquaternium-2, polyquaternium-4, polyquaternium-5, polyquaternium-6, polyquaternium-7, polyquaternium-8, polyquaternium-9, polyquaternium-10, polyquaternium-11, polyquaternium-12, polyquaternium-13, polyquaternium-14, polyquaternium-15, polyquaternium-16, polyquaternium-17, polyquaternium-18, polyquaternium-19, polyquaternium-20, polyquaternium-22, polyquaternium-24, polyquaternium-27, polyquaternium-28, polyquaternium-29, polyquaternium-30, polyquaternium-31, polyquaternium-32, polyquaternium-33, polyquaternium-34, polyquaternium-35, polyquaternium-36, polyquaternium-37, polyquaternium-39, polyquaternium-43, polyquaternium-44, polyquaternium-45, polyquaternium-46, polyquaternium-47, polyquaternium-48, polyquaternium-49, polyquaternium-50, polyquaternium-51, polyquaternium-56, polyquaternium-57, polyquaternium-61, polyquaternium-69 or polyquaternium-86 is suitable as a cationic polymer for coating the microcapsules. Polyquaternium-7 is more particularly preferred. The polyquaternium nomenclature used in this application for the cationic polymers is taken from the declaration for cationic polymers according to the International Nomenclature of Cosmetic Ingredients (INCI declaration) for cosmetic raw materials.

Microcapsules that can preferably be used have an average diameter $X_{50.3}$ in the range of 1 to 100 μm, preferably of 5 to 95 μm, in particular of 10 to 90 μm, for example of 10 to 80 μm.

The shell of the microcapsules surrounding the core or the (filled) cavity preferably has an average thickness in the range of approximately 5 to 500 nm, preferably of approximately 50 nm to 200 nm, in particular of approximately 70 nm to approximately 180 nm.

Pearlescing pigments are pigments that have a pearlescent shine. Pearlescing pigments consist of thin sheets that have a high refraction index, and partially reflect the light and are partially transparent to the light. The pearlescent shine is generated by interference of the light hitting the pigment (interference pigment). Pearlescing pigments are usually thin sheets of the above-mentioned material, or contain the above-mentioned material as thin, multilayered films or as components arranged in parallel in a suitable carrier material.

The pearlescing pigments that can be used according to the invention are either natural pearlescing pigments such as fish silver (guanine/hypoxanthine mixed crystals from fish scales) or mother of pearl (from ground seashells), monocrystalline, sheet-like pearlescing pigments such as bismuth oxychloride and pearlescing pigments with a mica base and a mica/metal oxide base. The latter pearlescing pigments are mica that has been provided with a metal oxide coating.

By using the pearlescing pigments in the suspension according to the invention, shine and optionally also color effects are achieved.

Pearlescing pigments with a mica base and mica/metal oxide base are preferred according to the invention. Mica is a phyllosilicate. The most important representatives of these silicates are muscovite, phlogopite, paragonite, biotite, lepidolite, and margarite. To produce the pearlescing pigments in conjunction with metal oxides, mica, primarily muscovite or phlogopite, is coated with a metal oxide. Suitable metal oxides are, inter alia, $TiO_2$, $Cr_2O_3$, and $Fe_2O_3$. Interference pigments and colored luster pigments are obtained as pearlescing pigments according to the invention by suitable coating. These pearlescing pigment types additionally have color effects as well as a glittering optical effect. Furthermore, the pearlescing pigments that can be used according to the invention also contain a color pigment that does not derive from a metal oxide.

The grain size of the pearlescing pigments that are preferably used is preferably between 1.0 μm and 100 μm, particularly preferably between 10.0 and 60.0 μm, at an average diameter $X_{50.3}$ (volume average).

Within the meaning of the invention, speckles are understood to be macroparticles, in particular macrocapsules, that have an average diameter $X_{50.3}$ (volume average) of greater than 300 μm, in particular of 300 to 1500 μm, preferably of 400 to 1,000 μm.

Speckles are preferably matrix capsules. The matrix is preferably colored. The matrix is formed for example by gelation, polyanion-polycation interactions or polyelectrolyte-metal ion interactions, and this is well known in the prior art, just like the preparation of particles using these matrix-forming materials. An example of a matrix-forming material is alginate. In order to prepare alginate-based speckles, an aqueous alginate solution, optionally also containing the active ingredient or active ingredients to be included, is drop-formed and is then hardened in a precipitation bath containing $Ca^{2+}$ ions or $Al^{3+}$ ions. Alternatively, other matrix-forming materials may be used instead of alginate.

The composition according to the invention may additionally contain further ingredients which further improve the practical and/or aesthetic properties of the composition, depending on the intended use. In the context of the present invention, the compositions according to the invention, in particular if they are suitable as a textile treatment agent (e.g. as a washing agent or softener), may contain builders, bleaching agents, bleach activators, bleach catalysts, esterquats, silicone oils, emulsifiers, thickeners, electrolytes, pH adjusters, fluorescing agents, dyes, hydrotropes, suds suppressors, anti-redeposition agents, solvents, enzymes, optical brighteners, graying inhibitors, anti-shrink agents, crease-preventing agents, dye transfer inhibitors, color-protection agents, wetting promoters, antimicrobial active ingredients, germicides, fungicides, antioxidants, corrosion inhibitors, preservatives, antistatic agents, ironing aids, waterproofing and impregnating agents, polymers, swelling and anti-slip agents and UV absorbers.

A composition according to the invention that is suitable as a textile treatment agent or cleaning agent preferably contains at least one water-soluble, organic and/or water-soluble, inorganic builder. The water-soluble organic builders include polycarboxylic acids, in particular citric acid, adipic acid, succinic acid, glutaric acid, malic acid, tartaric acid, maleic acid, fumaric acid and saccharic acids, monomeric and polymeric aminopolycarboxylic acids, in particular methylglycinediacetic acid, nitrilotriacetic acid, and ethylenediaminetetraacetic acid as well as polyaspartic acid, polyphosphonic acids, in particular amino tris(methylenephosphonic acid), ethylenediaminetetrakis(methylenephosphonic acid), and 1-hydroxyethane-1,1-diphosphonic acid, polymeric hydroxy compounds such as dextrin, and polymeric (poly)carboxylic acids, polymeric acrylic acids, methacrylic acids, maleic acids, and mixed polymers thereof, which may also contain small portions of polymerizable substances, without a carboxylic acid functionality, in the polymer. Compounds of this class which are suitable, although less preferred, are copolymers of acrylic acid or methacrylic acid with vinyl ethers, such as vinyl methyl ethers, vinyl esters, ethylene, propylene, and styrene, in which the proportion of the acid is at least 50 wt. %. The organic builders, in particular for preparing liquid textile treatment agents or cleaning agents, may be used in the form of aqueous solutions, preferably in the form of 30 to 50 wt. % aqueous solutions. All stated acids are generally used in the form of their water-soluble salts, in particular their alkali salts.

Preferred salts are the salts of polycarboxylic acids such as citric acid, adipic acid, succinic acid, glutaric acid, tartaric acid, saccharic acids, and mixtures thereof.

Organic builders, if desired, may be contained in quantities of up to 40 wt. %, in particular up to 25 wt. %, and preferably 1 wt. % to 8 wt. %. Quantities near the stated upper limit are preferably used in paste-form or liquid, in particular water-containing, compositions according to the invention. Laundry post-treatment agents, such as softeners, may optionally also be free of organic builders.

A composition according to the invention that is suitable as a textile treatment agent or cleaning agent preferably contains at least one enzyme. Suitable as enzymes that are can be used are those from the class of proteases, cutinases, amylases, pullulanases, hemicellulases, cellulases, lipases, oxidases, and peroxidases, and mixtures thereof. Enzymatic active ingredients obtained from fungi or bacteria, such as *Bacillus subtilis, Bacillus licheniformis, Streptomyces griseus, Humicola lanuginosa, Humicola insolens, Pseudomonas pseudoalcaligenes*, or *Pseudomonas cepacia* are particularly suitable. The optionally used enzymes may be adsorbed onto carrier substances and/or embedded in coating substances to protect the enzymes from premature inactivation. The enzymes, if desired, are preferably contained in the agents in quantities no greater than 5 wt. %, in particular 0.2 wt. % to 2 wt. %.

An optical brightener is preferably selected from the substance classes of distyrylbiphenyls, stilbenes, 4,4'-diamino-2,2'-stilbene disulfonic acids, cumarines, dihydroquinolones, 1,3-diarylpyrazolines, naphthalic acid imides, benzoxazole systems, benzisoxazole systems, benzimidazole systems, pyrene derivatives substituted with heterocycles, and mixtures thereof.

Particularly preferred optical brighteners include disodium-4,4'-bis-(2-morpholino-4-anilino-s-triazin-6-ylamino) stilbene disulfonate (for example available as Tinopal® DMS from BASF SE), disodium-2,2'-bis-(phenyl-styryl) disulfonate (for example available as Tinopal® CBS from BASF SE), 4,4'-bis[(4-anilino-6-[bis(2-hydroxyethyl) amino]-1,3,5-triazin-2-yl)amino]stilbene-2,2'-disulfonic acid (for example available as Tinopal® UNPA from BASF SE), hexasodium-2,2'-vinylenebis[(3-sulphonato-4,1-phenylene)imino[6-(diethylamino)-1,3,5-triazin-4,2-diyl] imino]]bis-(benzene-1,4-disulfonate) (for example available as Tinopal® SFP from BASF SE), 2,2'-(2,5-thiophendiyl) bis[5-1,1-dimethylethyl)-benzoxazole (for example available as Tinopal® SFP from BASF SE) and/or 2,5-bis(benzoxazol-2-yl)thiophene.

Furthermore, the compositions according to the invention that are suitable as textile treatment agents or cleaning agents may also contain components that positively influence the capability for washing out oil and grease from textiles, so-called soil release active ingredients. This effect is particularly apparent when a textile is soiled which has been previously washed several times with an agent that contains this oil- and grease-dissolving component. Preferred oil- and grease-dissolving components include, for example, non-ionic cellulose ethers such as methylcellulose and methylhydroxypropylcellulose with a proportion of 15 to 30 wt. % of methoxyl groups and 1 to 15 wt. % of hydroxypropoxyl groups, in each case based on the non-ionic cellulose ether, and the polymers of phthalic acid and/or terephthalic acid, known from the prior art, or the derivatives thereof with monomeric and/or polymeric diols, in particular polymers of ethylene terephthalates and/or polyethylene glycol terephthalates or anionically and/or non-ionically modified derivatives thereof.

The textile treatment agents or cleaning agents may also contain dye transfer inhibitors, preferably in quantities of 0.1 wt. % to 2 wt. %, in particular 0.1 wt. % to 1 wt. %, which in one preferred embodiment of the invention are polymers of vinylpyrrolidone, vinyl imidazole, vinyl pyridine-N-oxide, or copolymers thereof.

The function of graying inhibitors is to keep the dirt that is removed from the textile fiber suspended in the liquor. Water-soluble colloids, which are usually organic, are suitable for this purpose, for example starch, sizing material, gelatin, salts of ethercarboxylic acids or ethersulfonic acids of starch or of cellulose, or salts of acidic sulfuric acid esters of cellulose or of starch. Water-soluble polyamides containing acidic groups are also suitable for this purpose. Starch derivatives other than those mentioned above may also be used, for example aldehyde starches. Cellulose ethers such as carboxymethylcellulose (Na salt), methylcellulose, hydroxyalkylcellulose, and mixed ethers such as methylhydroxyethylcellulose, methylhydroxypropylcellulose, methylcarboxymethylcellulose, and mixtures thereof may preferably be used, for example in quantities of 0.1 to 5 wt. %, based on the agents.

It is preferable for the dye transfer inhibitor to be a polymer or a copolymer of cyclic amines such as vinylpyrrolidone and/or vinylimidazole. Polymers suitable as a dye transfer inhibitor include polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride, polyethylene glycol-modified copolymers of vinylpyrrolidone and vinylimidazole, and mixtures thereof.

Particularly preferably, polyvinylpyrrolidone (PVP), polyvinylimidazole (PVI) or copolymers of vinylpyrrolidone and vinylimidazole (PVP/PVI) are used as a dye transfer inhibitor. The polyvinylpyrrolidones (PVP) used preferably have an average molecular weight of 2,500 to 400,000 and are commercially available from ISP Chemicals as PVP K 15, PVP K 30, PVP K 60 or PVP K 90, or from BASF as Sokalan® HP 50 or Sokalan® HP 53. The copolymers of vinylpyrrolidone and vinylimidazole (PVP/PVI) used preferably have a molecular weight in the range of 5,000 to 100,000. A PVP/PVI copolymer is commercially available from BASF under the name Sokalan® HP 56. Other dye transfer inhibitors that can be extremely preferably used are polyethylene glycol-modified copolymers of vinylpyrrolidone and vinylimidazole, which for example are available from BASF under the name Sokalan® HP 66.

In particular, low-water, liquid compositions according to the invention may be in pre-portioned form, the composition according to the invention being placed into a water-soluble casing and thus possibly being a component of water-soluble packaging. If the composition according to the invention is packaged in a water-soluble casing, it is preferable for the water content to be between 5 and 20 wt. %, based on the total agent, and for anionic surfactants, if present, to be in the form of the ammonium salts thereof.

A second subject of the invention relates to the use of at least one said diarylamidocystine compound of formula (I) (vide supra) for preparing liquid surfactant compositions having a yield point.

A third subject of the invention relates to the use of such a surfactant composition as a continuous phase for preparing a suspension.

Another subject of the invention is directed to a method for textile treatment comprising the following method steps: providing a solution comprising a surfactant composition according to the first subject of the invention, and bringing a textile into contact with the solution according to (a).

For preparing said solution, it is preferred according to the invention for 10 to 110 g, in particular 15 to 100 g of the surfactant composition according to the first subject of the invention to be mixed with 5 to 25 l water, in particular with 10 to 20 l water.

In the washing process described, temperatures of 60° C. or less, for example 50° C. or less, are used in different embodiments of the invention. This temperature information relates to the temperatures used in the washing steps.

Another subject of the invention relates to a method for preparing a liquid surfactant composition according to the first subject of the invention, which is wherein water and surfactant, as well as optional additives if necessary, are brought to a temperature above the sol-gel transition temperature of the mixture in the presence of the diarylamidocystine compound of formula (I) (vide supra) and are then cooled.

The surfactant composition may also be temperature-controlled in advance up to said temperature without the diarylamidocystine compound of formula (I) and cooled after the diarylamidocystine compound of formula (I) is added.

The sol-gel transition temperature can be determined in advance using known methods. For example, said temperature can be determined using a rheological measurement with oscillating deformation of constant frequency as a function of the temperature. In a measurement of this type, disruption of the modulus of the sample can be observed when the sol-gel transition temperature is exceeded. Likewise, the sol-gel transition can often also be visually detected by the naked eye.

EXAMPLES

The following compositions E1 (according to the invention) and V1 (comparison) were prepared. In the process, the composition was prepared in a conventional manner by mixing all the components except for the diarylamidocystine compound. The resulting mixture was then heated to 90° C. and N,N'-dibenzoyl-L-cystine was homogeneously stirred in, and then said mixture was cooled to room temperature.

The yield points of compositions E1 and V1 were then determined using the above-described measurement methods.

TABLE 1

| Raw material | E1 [wt. %] | V1 [wt. %] |
|---|---|---|
| $C_{10-13}$ alkyl benzene sulfonic acid (>30 wt. % 2-phenyl isomer) | 7.2 | 7.2 |

TABLE 1-continued

| Raw material | E1 [wt. %] | V1 [wt. %] |
|---|---|---|
| Fatty alcohol ether sulfate with 2 mol ethylene oxide | 3.9 | 3.9 |
| $C_{13-15}$ alkyl ether with 7 mol ethylene oxide | 6.9 | 6.9 |
| Phosphonate | 0.65 | 0.65 |
| Citric acid monohydrate | 3.2 | 3.2 |
| NaOH (50 wt. % solution in water) | 6.2 | 6.2 |
| $C_{12-18}$ coconut fatty acid | 2.9 | 2.9 |
| 1,2-Propanediol | 5.6 | 5.6 |
| ethanol | 2.1 | 2.1 |
| N,N'-Dibenzoyl-L-cystine | 0.99 | — |
| Enzymes (protease, amylase, cellulase, lipase, mannanase) | 0.4 | 0.4 |
| Boric acid | 0.6 | 0.6 |
| Perfume oil | 1.2 | 1.2 |
| Other additives (preservatives, defoamers, optical brighteners, dyes) | 9.3 | 9.3 |
| Water | Remainder | Remainder |
| Yield point | 0.02 Pa | not measurable |

Composition E1 was also thickened.

What is claimed is:

1. A method for textile treatment comprising the following method steps:

(a) providing a solution comprising a liquid surfactant composition having a yield point comprising, based on the total weight thereof, (i) at least one surfactant in a total quantity of 1 to 70 wt. %, and (ii) at least one diarylamidocystine compound of the formula (I),

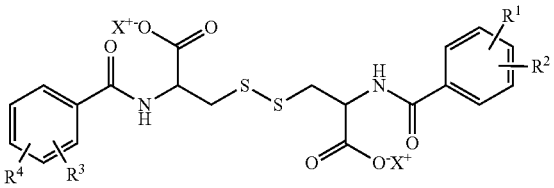

wherein $X^+$, independently of each other, stands for a hydrogen atom or an equivalent of a cation, R1, R2, R3, and R4, independently of each other, stand for a hydrogen atom, a halogen atom, a C1-C4 alkyl group, a C1-C4 alkoxy group, a C2-C4 hydroxyalkyl group, a hydroxyl group, an amino group, an N—(C1-C4 alkyl) amino group, an N,N-Di(C1-C4 alkyl)amino group, an N—(C2-C4 hydroxyalkyl)amino group, an N,N-Di (C2-C4 hydroxyalkyl)amino group, or R1 with R2 or R3 with R4 forms a 5- or 6-segment annulated ring, which in turn can each be substituted with at least one group from C1-C4 alkyl group, C1-C4 alkoxy group, C2-C4 hydroxyalkyl group, hydroxyl group, amino group, N—(C1-C4 alkyl)amino group, N,N Di(C1-C4 alkyl)amino group, N—(C2-C4 hydroxyalkyl)amino group, N,N-Di(C2-C4 hydroxyalkyl)amino group, and (iii) water, and (b) bringing a textile into contact with the solution according to (a).

2. The method according to claim 1, wherein the yield point of the liquid surfactant composition is at least 0.01 to 5 Pa (20° C.).

3. The method according to claim 1, wherein the liquid surfactant composition comprises at least one anionic surfactant.

4. The method according to claim 1, wherein the liquid surfactant composition comprises at least one anionic surfactant selected from the group consisting of C8-18 alkylbenzene sulfonates, olefin sulfonates, C12-18 alkane sulfonates, ester sulfonates, alk(en)yl sulfates, fatty alcohol ether sulfates and mixtures thereof.

5. The method according to claim 1, wherein the liquid surfactant composition comprises at least one compound of formula (I-3) as a surfactant,

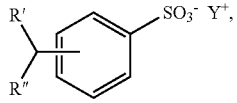

(I-3)

in which

R' and R", independently of each other, are H or alkyl, and together contain 9 to 19 C atoms, and Y+ indicates a monovalent cation or the n-th part of an n-valent cation.

6. The method according to claim 1, wherein the liquid surfactant composition comprises at least one non-ionic surfactant.

7. The method according to claim 1, wherein the liquid surfactant composition comprises at least one non-ionic surfactant of formula (T2) as the surfactant R2-O—(XO)m-H, (T2)

in which

R2 stands for a linear or branched C8-C18 alkyl functional group, an aryl functional group or an alkyl aryl functional group, XO independently of each other stands for an ethylene oxide (EO) group or a propylene oxide (PO) group, m stands for integers from 1 to 50.

8. The method according to claim 1, wherein the liquid surfactant composition comprises based on the total weight thereof, a total surfactant content of 1.0 to 40 wt. %.

9. The method according to claim 1, wherein the liquid surfactant composition comprises N,N' dibenzoylcystine as a diarylamidocystine compound of formula (I).

10. The method according to claim 1, wherein the liquid surfactant composition comprises the diarylamidocystine compound of formula (I) in a total quantity of 0.1 to 5.0 wt. % based on the total weight of the composition.

11. The method according to claim 1, wherein the liquid surfactant composition comprises suspended solid particles.

* * * * *